US006217376B1

(12) United States Patent
Morita

(10) Patent No.: US 6,217,376 B1
(45) Date of Patent: Apr. 17, 2001

(54) DUSTPROOF PROTECTION COVER AND METHOD OF USING A DUSTPROOF PROTECTION COVER

(75) Inventor: Yoshimitsu Morita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/345,775

(22) Filed: Jul. 1, 1999

(30) Foreign Application Priority Data

Jul. 2, 1998 (JP) ..... 10-187246

(51) Int. Cl.[7] ..... H01R 13/52
(52) U.S. Cl. ..... 439/519
(58) Field of Search ..... 439/519; 119/1, 119/19; 229/13, 62, 80; 428/36.1, 36.2, 36.3, 36.4, 36.5, 343; 206/216; 128/849–850

(56) References Cited

U.S. PATENT DOCUMENTS

| | | | | |
|---|---|---|---|---|
| 3,942,713 | * | 3/1976 | Olson et al. | 229/62 |
| 4,977,857 | * | 12/1990 | Slawinski | 119/19 |
| 5,536,904 | | 7/1996 | Kojima et al. | 174/23 |

FOREIGN PATENT DOCUMENTS

| | | |
|---|---|---|
| 5-23462 | 3/1993 | (JP) . |
| 8-273745 | 10/1996 | (JP) . |

* cited by examiner

*Primary Examiner*—Gary F. Paumen
*Assistant Examiner*—Alexander Gilman
(74) *Attorney, Agent, or Firm*—Greenblum & Bernstein, P.L.C.

(57) ABSTRACT

A dustfree protection cover is provided to be mounted on a connector of a wire harness. The dustfree protection cover is formed as a bag with the one end open, an adhesive tape provided with a release paper is attached to an inner side of the open end, and a notch is formed on one end of the opening. The notch extends downwardly from the upper end of the bag to a side end of a heat-seal closed area, and over a lower end position of the adhesive tape. The bag is placed over the connector, and wires extend through the notch, whereby, upon removal, the bag is pulled off and the heat-sealed closed area is torn away. A method of covering an attached member on a wire harness is also provided which includes providing cover for covering an attached member connected by a connection member to a wire harness, the cover is configured as a bag having a front side, a back side, opposed side edges, a bottom, and a top, an adhesive is provided on at least one of the front and back sides to selectively close the open end, and an angled notch extends from a position at the top of the bag and downwardly to a position at one side edge to form an opening in the bag. The method includes placing the open end of said bag over the attached member, such that the connection member extends through the opening formed by notch, and closing the open end by adhering the adhesive to the other of the front and back sides such that the attached member is retained therein, with the attached member suitably covered by the bag to provide dustfree protection.

16 Claims, 6 Drawing Sheets

FIG. 1
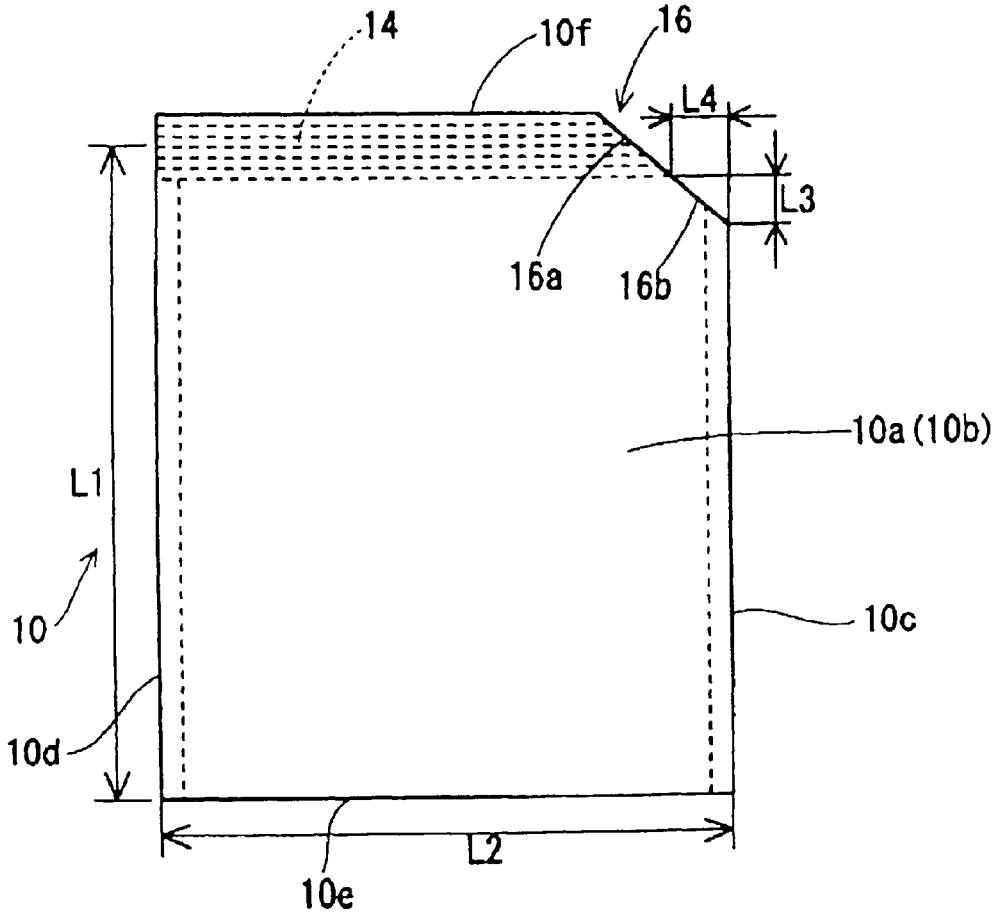
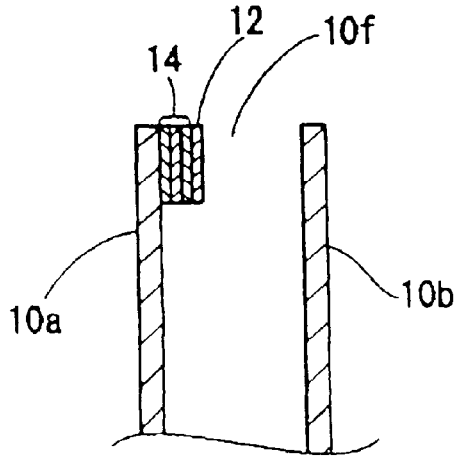
FIG. 2(A)
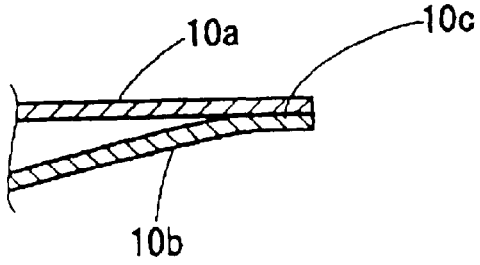
FIG. 2(B)

DUSTPROOF PROTECTION COVER AND METHOD OF USING A DUSTPROOF PROTECTION COVER

BACKGROUND OF THE INVENTION

1. Field of the Invention

The present invention relates to a dustfree protection cover, and, particularly, to a dustfree protection cover used preferably by first covering a connector connected with a branched wire terminal of a wire harness, the cover being later removed from the connector when mounting it in an automobile.

2. Description of Background Information

Conventionally, dust intrusion into a connector is protected in such a manner that a dustfree protection cover is applied to required connectors among the connectors which are connected with branched wire terminals of a wire harness until the wire harness manufactured by a wire harness manufacturer is mounted in an automobile during manufacture of the vehicle.

The dustfree protection cover as has conventionally been applied consists of a generally rectangular polyethylene bag 1 as shown in FIG. 7, with the one end of a main body of the bag being heat-sealed and designated as closed end 1*a,* and having an open end 1*b* located oppositely. Using the bag 1 and a rubber band 2, the bag 1 is mounted and fastened with the rubber band 2 after positioning the bag 1 over a required connector C wire harness W/H as shown in FIG. 8.

More specifically, by placing the open end 10*f* of the bag 1 over a connector C connected with the terminal of the branched wire 4 from a main wire 3 of wire harness W/H, and then placing a rubber band 2 the over outer periphery of the bag 1 at a position on the branched wire 4, the bag 1 is mounted so that it will not be removed from the connector C.

Under this condition, delivery is made from a wire harness manufacturer to a automobile manufacturer, and the bag 1 is removed by loosening the rubber band 2, as shown in FIG. 9, by the automobile manufacturer, and then the bag 1 is removed from the connector C.

When removing the bag 1 at the automobile manufacturer, since workers usually wear gloves or the like, it is usually very difficult to remove the rubber band 2. In addition, when pulling off the bag 1 without removing the rubber band 2, the rubber band usually remains surrounding the branched wire 2, which will eventually cause other problems such as being clamped into other members or being caught by other members in the processes which follow.

Furthermore, since the covering member to be removed includes two different members such as a bag 1 and a rubber band 2, which necessitates removal and collecting both items without scattering, handling this matter poses a labor intensive problem.

The present invention was made in order to overcome the above-mentioned problems, and an object is to provide a dustfree protection cover capable of easy removal without generating any residue on a wire harness at the automobile manufacturer by first covering the connector and the like with a protection cover including only a bag, without necessitating use of a rubber band, which results in a device capable of easy removal.

SUMMARY OF THE INVENTION

In order to solve the above-mentioned problems, the present invention provides a dustfree protection cover to be removed when in use by first covering attached members that are connected with a main member. The dustfree protection cover covers attached members connected with a main member when in use, and the cover includes a bag having an open end, and an adhesive tape provided with a release paper attached to an inner side of the bag at the open end forming an opening. The bag is provided with a notch on one side end of the opening, with the notch extending from an upper portion of said adhesive tape, downwardly over a lower end portion of the said adhesive tape and to a side edge of the bag. Thereafter, an attached member to be covered with the bag is inserted into the bag through the open end, and a connection area of the attached member to the main member extends through the notch where the adhesive tape is not mounted, whereafter the open end is closed with the adhesive tape after releasing the release paper. Thus, in order for removal, the bag is broken in an area of the notch through which the connecting area extends when the bag is pulled in a removal direction, and the bag can then be removed.

As mentioned above, because the notches are provided on one side end of the opening, a connecting area alone is formed for removal in the area where the notch is not closed with the adhesive, and the opening is closed with the adhesive, the cover cannot be removed from the attached member unless a separation force is applied thereto by a person, thereby achieving sufficient protection to the attached member. On the other hand, when removing the cover, only a pulling force in the direction of removal of the cover is required, and the cover can be removed from the attached part due to a tear caused at the connecting area which extends from a lower area of the notch and the side of cover with which the attached members are in contact.

The opening may be closed with both sides of inner surfaces of the open end adhered with an adhesive material. Alternatively, one side of the bag may be formed to be to extend beyond the other side to form a flap, and an adhesive material is applied to the inner surface of the extending side, such that the open end may be closed with the extending adhesive-applied area folded over the outer surface of other side and adhered thereon.

The bag is formed of a resin sheet having a generally rectangular-shape, and may be formed of polyethylene or similar materials, and is double folded. Both sides of the bag are heat sealed to form a closed area on the bag with one end open. A lower end of the notch is positioned at a heat seal closed area, and the heat seal closed area is torn after pulling the bag upon removal.

As mentioned above, forming a bag-like cover by heat-sealing the folded sheet with the heat sealing applied on opposite side edges allows the cover to be easily removed due to easier tearing of the heat-sealed area, compared with other parts of the sheet, without causing any release of the adhered area applied with the adhesive material. The shape of the above-mentioned notch may preferably have a slanted form, which makes it easier to perform smooth tearing of the heat-sealed area.

The above-mentioned main member includes a wire harness to be arranged in an automobile, the attached member includes a connector connected with a terminal of the wire harness, the bag covers the connector, and a branched wire of the wire harness connected with the connector extends out from a notch in the bag at the connecting area.

According to one aspect of the invention, the dustfree protection cover includes a bag formed of a resin sheet having a generally rectangular-shape which is double folded, and opposite side edges thereof are heat sealed to form a closed area in the bag with one end open, and the lower end of the notch extends to the heat sealed closed area, whereby the heat sealed closed area is torn after pulling the bag during removal. Additionally, the resin sheet may be formed of polyethylene or any suitable synthetic resin material.

According to another aspect of the invention the dustfree protection cover includes a combination with the main member and the attached member, wherein the main member includes a wire harness to be arranged in an automobile, the attached member includes a connector connected with a terminal of the wire harness, the bag is provided to cover the connector, and a branched wire of the wire harness connected with the connector forms the connection area and extends out from the notch of the bag.

In a further aspect of the invention, a dustfree protection cover is provided to cover an attached member connected by a connection member with a main member when in use, and the cover includes a bag having a front side, a back side, opposed side edges, a bottom, and a top forming an open end. The bag further includes an adhesive provided on at least one of the front and back sides to selectively close the open end, and an angled notch extends from a position at the top of the bag and downwardly to a position at one side edge. The bag is constructed and arranged such that, during use, the open end is placed over an attached member, with the connection member extending through an opening formed by the notch, whereafter the open end is closed by adhering the adhesive to the other of the front and back sides, thereby retaining the attached member therein. Moreover, the bag is removable from the attached member by pulling on the bag to sever portions of the bag in the area of the notch adjacent the attached member. Additionally, the notch may extend over and below the adhesive to the one side edge, leaving a portion of the notch void of adhesive to form the opening. Alternatively, the notch may extend over and below the adhesive to the one side edge, leaving a portion of the notch void of adhesive, and the opening may include the portion of the notch void of adhesive and a portion of the notch including the adhesive to receive a large connection member.

In a further aspect of the present invention, the bag is formed from a generally rectangular sheet of material which is folded to form the bottom, and opposite side edges thereof are sealed to form the opposed side edges, such that the opening is located adjacent one sealed side edge which is easily severed by pulling on the bag during removal thereof. The adhesive may also be provided with a release paper which is removed prior to closing the open end.

According to another aspect of the present invention, the bag forming the dustfree protection cover is constructed and arranged such that one of the front and back sides is configured to extend outwardly beyond the other of the front and back sides to form a flap, and the flap is securable to the other side by the adhesive in a plurality of selected positions to permit the opening through which the connection member extends to be adjustable, in an operative position of the bag. The bag is constructed and arranged such that, during use, the open end is placed over an attached member, whereafter the flap is folded over and secured in position by the adhesive, with the connection member extending through the opening to thereby retain the attached member therein. The bag may also be formed from a generally rectangular sheet of material which is folded to form the bottom, and opposite side edges thereof are sealed to form the opposed side edges, such that the opening is located adjacent one sealed side edge which is easily severed by pulling on the bag during removal thereof. Furthermore, the adhesive may also be provided with a release paper which is removed prior to closing the open end.

In a further aspect of the present invention, a method of covering an attached member on a wire harness is provided that includes providing a dustfree protection cover for covering an attached member connected by a connection member to a wire harness, the cover being configured as a bag having a front side, a back side, opposed side edges, a bottom, and a top, an adhesive is provided on at least one of the front and back sides to selectively close the open end, and an angled notch extends from a position at the top of the bag and downwardly to a position at one side edge to form an opening in the bag. The method further includes placing the open end of the bag over the attached member, such that the connection member extends through the opening formed by the notch, and closing the open end by adhering the adhesive to the other of the front and back sides such that the attached member is retained therein, with the attached member suitably covered by the bag to provide dustfree protection. The method further includes removing the bag from the attached member by pulling on the bag to sever portions of the bag in the area of the notch adjacent the attached member.

In another aspect of the invention, the method of covering an attached member on a wire harness further includes providing a flap on one side of the front and back sides, folding the flap over the other of the front and back sides, and securing the flap with the adhesive in a selected position to adjust a size of the opening to thereby accommodate various sized connection members.

As mentioned above, the dustfree protection cover in reference to the present invention is preferably applied to the protection of connectors connected with a wire harness, but it is not limited to this scope, and can be used as a protection cover for members attached to another appropriate main member.

BRIEF DESCRIPTION OF THE DRAWINGS

The above and other objects, features and advantages of the present invention will be made apparent from the following description of the preferred embodiments, given as non-limiting examples, with reference to the accompanying drawings, in which:

FIG. 1 depicts a front elevation view of a dustfree protection cover according to a first embodiment of the present invention.

FIG. 2(A) depicts a sectional view along line A—A in FIG. 1, and FIG. 2(B) depicts a sectional view along line B—B in FIG. 1.

DETAILED DESCRIPTION OF THE INVENTION

Figure 3:
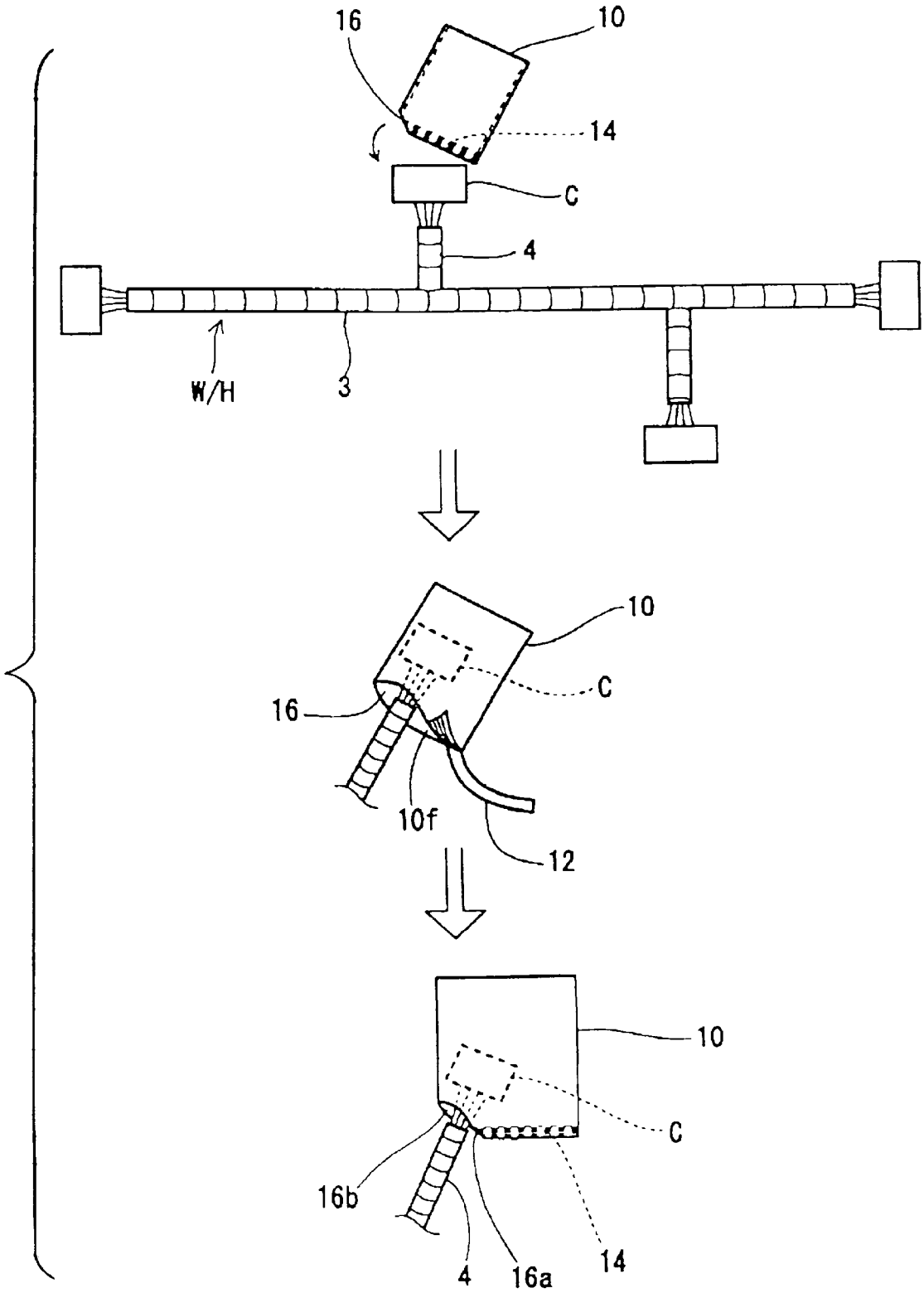
FIG. 3 illustrates mounting of the dustfree protection cover according to the first embodiment on a connector.

Description follows of the embodiments of the present invention with reference to the drawings as follows below.

FIG. 1 to FIG. 5 show a first embodiment of the present invention, in which a dustfree protection cover 10 having the structure shown respectively in FIG. 1 and FIGS. 2(A) and (B), with a rectangular-shaped, thin polyethylene sheet, having a thickness of about 0.03 mm, which is folded at the bottom. Both side edges of the folded front and back sides 10*a* and 10*b* are heat-sealed at a width of about 3 mm, thus forming opposed closed side areas 10*c* and 10*d,* with the folded edge designated as a lower end closed area 10*e,* thereby forming a rectangular-shaped bag having an opening area 10 at the upper end thereof. In this case, the vertical dimension L1 of the cover 10 is about 200 mm and the horizontal dimension L2 is about 100 mm in the present embodiment. However, the dustfree protection cover 10 may have any suitable dimensions L1, L2 to provide a cover sized to fit any element to be covered. Also, the sheet of material from which the cover 10 is formed may be any suitable synthetic resin and may have any suitable thickness.

An adhesive tape 14 provided with a release paper 12 is adhered to the inner surface of the cover 10 at the open end of the front side 10*a* as seen in FIG. 2(A). In addition, by forming notches on both front and back sides 10*a* and 10*b* at one side end of the open end 10*f,* a sloped notch 16 is provided. The notch 16 extends from the upper end to below the lower end position of the adhesive tape 14, as seen in FIG. 1. That is, an upper half area 16*a* of the notch 16 is positioned at the area of the adhesive tape 14 whereas a lower half area 16*b* is positioned at the area where the adhesive tape is not attached. With the present embodiment, a vertical dimension L3 of the lower half area 16*b* is about 15 mm, a horizontal dimension L4 of the lower half area 16*b* is about 15 mm, and the angle is formed by the notch 16 relative to the top 10*f* and side 10*c* is about 45°. Of course, dimensions L3 and L4 may be selected to have any suitable dimension, and the angle of the notch 16 is not limited to any particular angle.

As shown in FIG. 3, the dustfree protection cover 10 is used as a protection cover for a connector C connected with a terminal of branch wire 4 branched from a main wire 3 of a wire harness W/H. For mounting the protection cover 10, first of all, the cover 10 is positioned with the open end 10*f* toward the connector C, with the open end 10*f* widely opened. Next, the notch 16 is located at the position of the branch wire 4 connected with the connector C, and the release paper 12 is peeled from the adhesive tape 14. Finally, the open end 10*f* is closed by applying the adhesive tape 14 to the inner surface of the back side 10*b*.

Under this condition, only the branch wire 4 extends through the lower half area 16*b* of the notch 16, and the upper half area 16*a* is closed by the adhesive material. Therefore, the connector C is housed within the closed bag and is thus protected under the condition such that no dust will enter.

Figure 4:
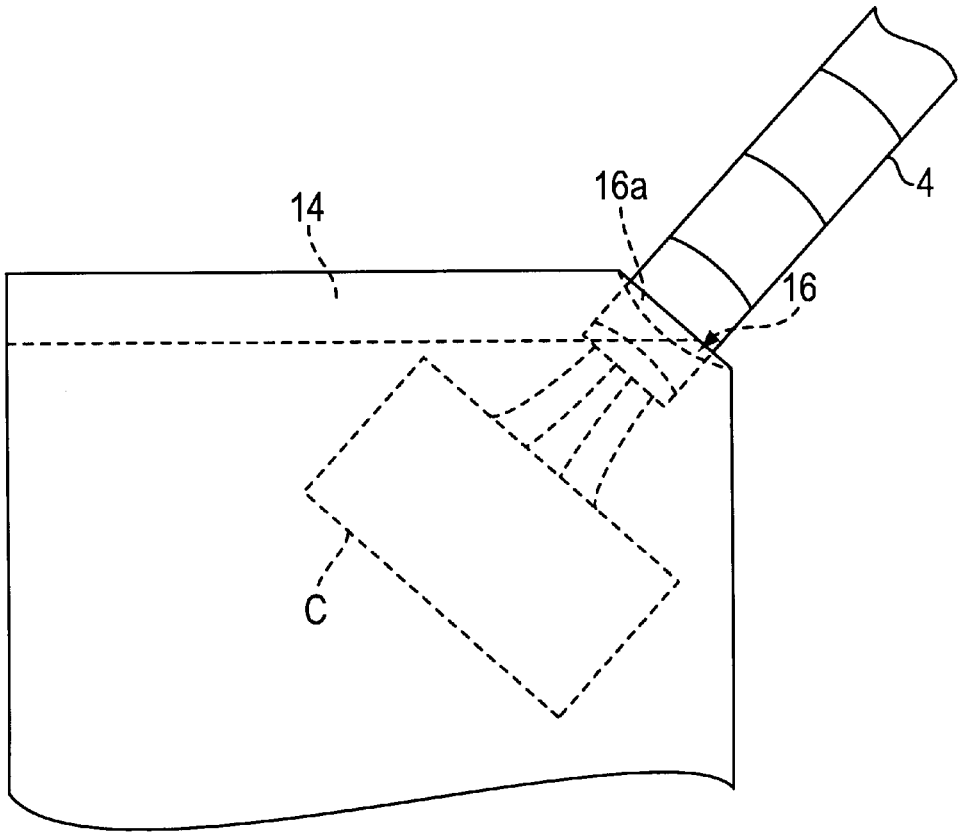
FIG. 4 depicts modification of the embodiment of FIG. 3.

In case of difficulty in extending the branch wire 4 through the lower half area 16*b* of the notch alone due to a large number of wires of the branch wire 4 connected with the connector C, the branch wire 4 can be extended without complete closing of the adhesive 14 by selective use of adhesive material in the upper half area 16*a* as shown in FIG. 4. That is, in accordance with the quantity of wire at the branch wire 4, the amount of opening area of the notch 16 can easily be adjusted.

The wire harness W/H having dustfree protection cover 10 protecting the connector C is delivered to an automobile manufacturer under the condition in which the dustfree protection cover 10 covers the connector C as described above. Subsequently, the dustfree protection cover 10 is removed as shown in FIG. 5 by the automobile manufacturer.

Figure 5:
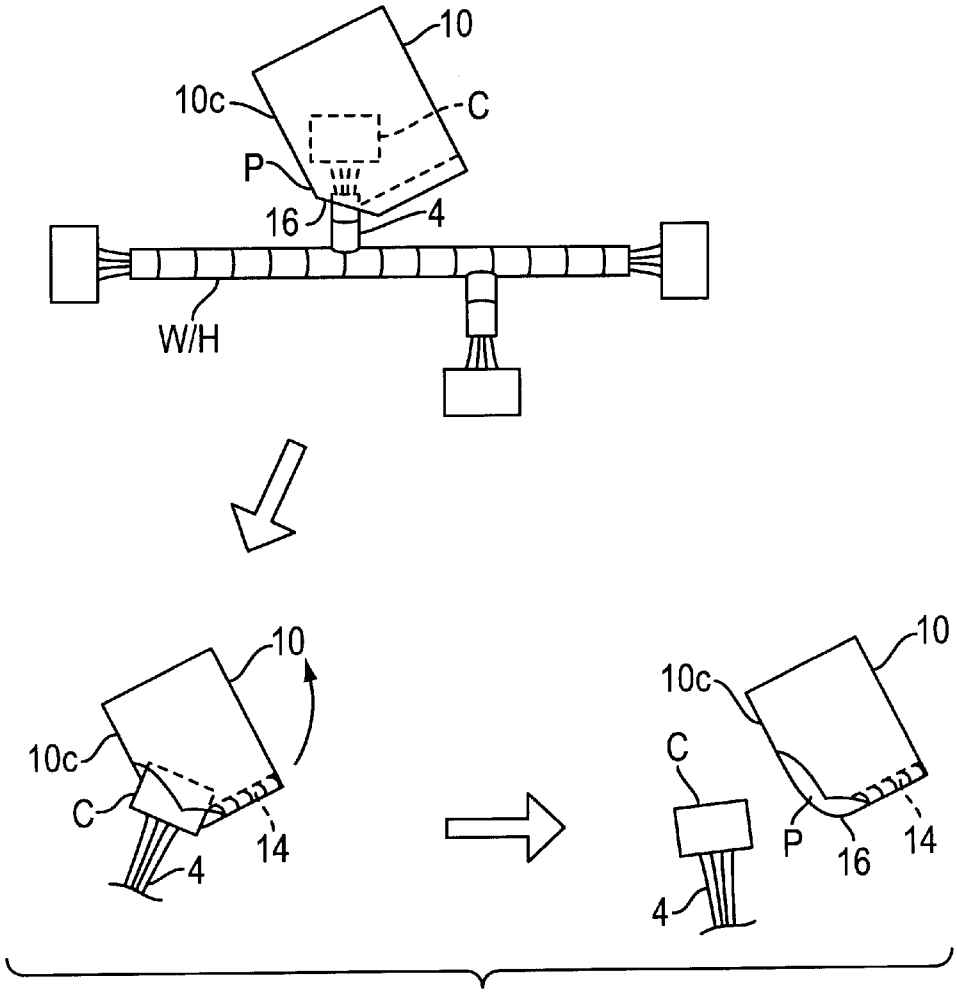
FIG. 5 illustrates the removal of the dustfree protection cover of the first and a second embodiment of the present invention.

That is, in order that the branch wire 4 and connector 3 can make good contact with the lower point P of the lower half area 16*b* at which the branch wire 4 extends through the notch 16, the cover 10 is pulled upwardly in a removal direction as shown by the arrow in FIG. 5. With this pulling force, a continuously heat-seal closed side area 10*c* at the lower end point P is torn as both sides 10*a* and 10*b* are separated from each other. That is, because the heat-sealed closed side area 10*c* is easier to tear than the other areas, the cover 10 can be removed without peeling the closed area to which adhesive tape 14 is applied.

However, in the case where the connector C is extraordinarily larger, the heat-seal closed side area 10*c* will be torn, and at the same time the open end 10*f* closed with adhesive tape 14 will also be peeled, and the cover 10 will be rapidly removed from the connector C.

Figure 6:
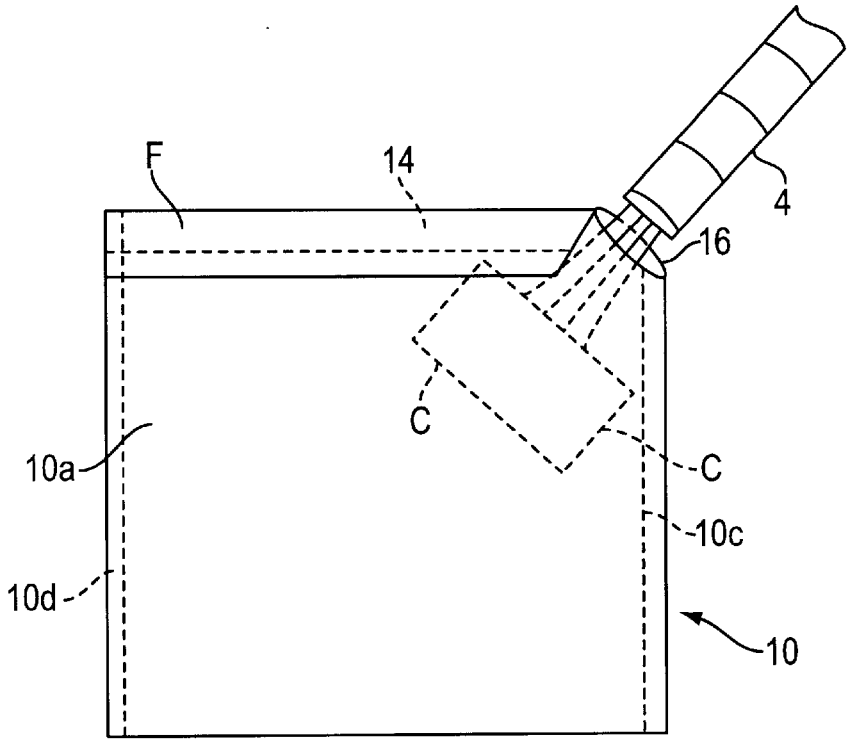
FIG. 6 depicts a front elevation view of a second embodiment of the present invention.
Figure 7:
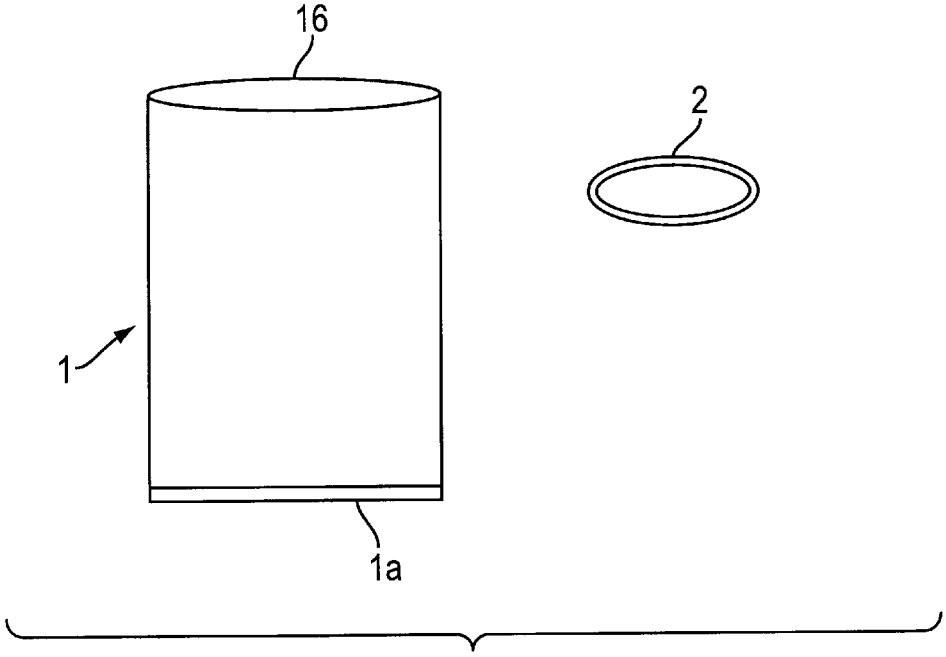
FIG. 7 (PRIOR ART)
FIG. 7 is a schematic drawing showing the conventional dustfree protection cover and rubber band.
Figure 8:
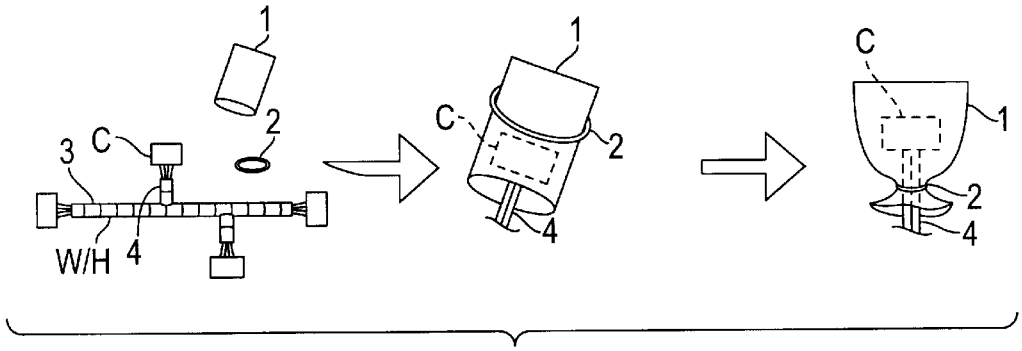
FIG. 8 (PRIOR ART)
FIG. 8 illustrates mounting of the conventional dustfree protection cover.
Figure 9:
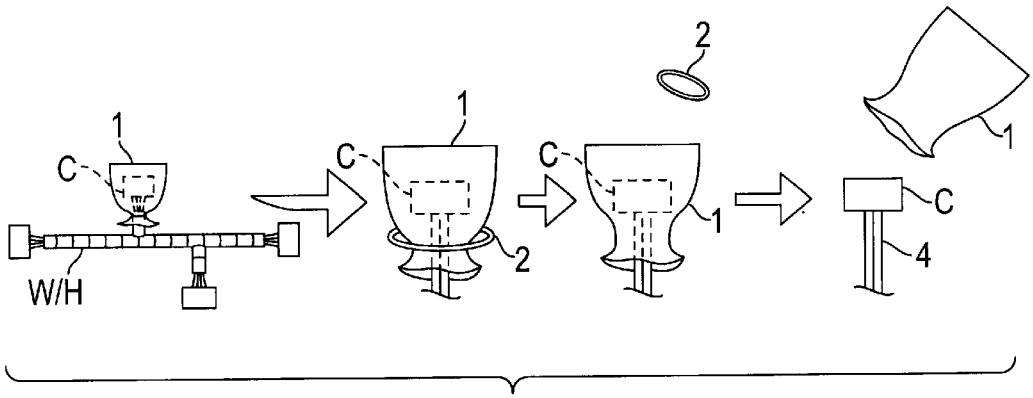
FIG. 9 (PRIOR ART)
FIG. 9 illustrates removal of the conventional dustfree protection cover.

FIG. 6 shows a second embodiment of the present invention in which the cover 10 has a back side 10*b* which is longer than the front side 10*a*. The back side extends above the open end of front piece 10*a* thus forming a flap F, and an adhesive tape 14 adhered with release paper is mounted on the inner surface of the flap F of back side 10*b*. When closing the opening, the open end is closed by folding the flap F over the upper portion of front side 10*a* (as seen in FIG. 6) and then the adhesive tape 14 is applied to the outer surface of the front side 10*a*.

In the folding type dustfree protection cover having the flap F described above, the size of slanted notch 16 at the one end can be easily adjusted by selectively adjusting the amount of the flap that is folded onto the front side 10*a*.

As is evident from the above description, the dustfree protection cover of the present invention does not require a rubber band or other similar fastening device as have conventionally been required. This assures complete mounting on attached members by merely closing the dustfree protection cover with an adhesive tape which is preliminary adhered to the opening end, by first placing the cover alone over the attached members of the connector or the like. Moreover, when removing the cover, merely pulling the cover assures easy removal because the cover is torn at the end having the notch.

Particularly, when both sides of dustfree cover are heat-sealed to form closed areas, and the tip end of notch is positioned at a heat-seal closed area, the heat-sealed closed area is easily and smoothly torn when removing the cover, thereby assuring far easier removal of the cover.

In addition, when removing the dustfree protection cover, mere removal and disposal of the cover eliminates additional collecting work heretofore required for additional members such as rubber band, thus assuring improvement in workability.

Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

The present disclosure relates to subject matter contained in priority Japanese Application No. JP 10-187246, filed on Jul. 2, 1998, which is herein expressly incorporated by reference in its entirety.

What is claimed is:

1. A dustfree protection cover that covers attached members connected with a main member when in use, said cover comprising:

a bag having an open end, an adhesive tape provided with a release paper attached to an inner side of said bag at the open end forming an opening, such bag provided with a notch on one side end of the opening, said notch extending from an upper portion of said adhesive tape, downwardly over a lower end portion of the said adhesive tape and to a side edge of said bag;

whereby an attached member to be covered with the bag is inserted into the bag through said open end, a connection area of the attached member to the main member extending through said notch where the adhesive tape is not mounted, whereafter said open end is closed with the adhesive tape after releasing the release paper, such that in order for removal, the bag is broken in an area of said notch through which the connecting area extends when the bag is pulled in a removal direction and can then be removed.

2. A dustfree protection cover as set forth in claim 1 in combination with the main member and the attached member, wherein the main member includes a wire harness to be arranged in an automobile, the attached member includes a connector connected with a terminal of the wire harness, said bag covers the connector, and a branched wire of the wire harness connected with the connector forms the connection area and extends out from said notch of said bag.

3. A dustfree protection cover as set forth in claim 1, wherein said bag is formed of a resin sheet having a generally rectangular-shape which is double folded, with opposite side edges thereof being heat sealed to form a closed area in the bag with one end open to form said open end, the lower end of said notch extending to said heat sealed closed area, and whereby said heat sealed closed area is torn after pulling the bag during removal.

4. A dustfree protection cover as set forth in claim 2 in combination with the main member and the attached member, wherein the main member includes a wire harness to be arranged in an automobile, the attached member includes a connector connected with a terminal of the wire harness, said bag covers the connector, and a branched wire of the wire harness connected with the connector forms the connection area and extends out from said notch of said bag.

5. A dustfree protection cover as set forth in claim 2, wherein said resin sheet comprises polyethylene.

6. A dustfree protection cover that covers an attached member connected by a connection member with a main member when in use, said cover comprising:

a bag having a front side, a back side, opposed side edges, a bottom, and a top forming an open end, said bag further including an adhesive provided on at least one of the front and back sides to selectively close the open end, and an angled notch extending from a position at the top of the bag and downwardly to a position at one side edge;

said bag being constructed and arranged such that, during use, said open end being placed over an attached member, with the connection member extending through an opening formed by said notch, whereafter said open end being closed by adhering said adhesive to the other of the front and back sides, thereby retaining the attached member therein, and whereby said bag is removable from the attached member by pulling on the bag to sever portions of the bag in the area of said notch adjacent the attached member.

7. A dustfree protection cover as set forth in claim 6, wherein said notch extends over and below the adhesive to said one side edge, leaving a portion of said notch void of adhesive to form said opening.

8. A dustfree protection cover as set forth in claim 6, wherein said notch extends over and below the adhesive to said one side edge, leaving a portion of said notch void of adhesive, and said opening includes said portion of said notch void of adhesive and a portion of said notch including said adhesive to receive a large connection member.

9. A dustfree protection cover as set forth in claim 6, wherein said bag is formed from a generally rectangular sheet of material which is folded to form said bottom, and opposite side edges thereof are sealed to form said opposed side edges, such that said opening is located adjacent one sealed side edge which is easily severed by pulling on the bag during removal thereof.

10. A dustfree protection cover as set forth in claim 6, wherein said adhesive is provided with a release paper which is removed prior to closing said open end.

11. A dustfree protection cover as set forth in claim 6, wherein one of said front and back sides is configured to extend outwardly beyond the other of said front and back sides to form a flap, and said flap being securable to said other side by said adhesive in a plurality of selected positions to permit said opening through which the connection member extends to be adjustable, in an operative position of said bag;

said bag being constructed and arranged such that, during use, said open end being placed over an attached member, whereafter said flap being folded over and secured in position by the adhesive, with the connection member extending through said opening to thereby retain the attached member therein.

12. A dustfree protection cover as set forth in claim 11, wherein said bag is formed from a generally rectangular sheet of material which is folded to form said bottom, and opposite side edges thereof are sealed to form said opposed side edges, such that said opening is located adjacent one sealed side edge which is easily severed by pulling on the bag during removal thereof.

13. A dustfree protection cover as set forth in claim 11, wherein said adhesive is provided with a release paper which is removed prior to closing said open end.

14. A method of covering an attached member on a wire harness comprising:

providing a dustfree protection cover for covering an attached member connected by a connection member to a wire harness, said cover being configured as a bag having a front side, a back side, opposed side edges, a bottom, and a top, an adhesive provided on at least one of the front and back sides to selectively close the open end, and an angled notch extending from a position at the top of the bag and downwardly to a position at one side edge to form an opening in said bag;

placing said open end of said bag over the attached member, such that the connection member extends through said opening formed by said notch;

closing said open end by adhering the adhesive to the other of the front and back sides such that the attached member is retained therein, with the attached member suitably covered by the bag to provide dustfree protection.

15. The method of covering an attached member on a wire harness according to claim 14, further comprising:

removing said bag from the attached member by pulling on the bag to sever portions of the bag in the area of said notch adjacent the attached member.

16. The method of covering an attached member on a wire harness according to claim 14, further comprising:

providing a flap on one side of the front and back sides;

folding said flap over the other of the front and back sides;

securing said flap with said adhesive in a selected position to adjust a size of said opening to thereby accommodate various sized connection members.

* * * * *